US006263820B1

(12) United States Patent
Crifase et al.

(10) Patent No.: US 6,263,820 B1
(45) Date of Patent: Jul. 24, 2001

(54) BOAT LANDING APPARATUS

(76) Inventors: Philip A. Crifase; Joy P. Crifase, both of 7623 Sussex Creek Dr. #303, Darien, IL (US) 60561

( * ) Notice: Subject to any disclaimer, the term of this patent is extended or adjusted under 35 U.S.C. 154(b) by 0 days.

(21) Appl. No.: 09/691,757

(22) Filed: Oct. 18, 2000

(51) Int. Cl.[7] ..... B63B 59/02
(52) U.S. Cl. ..... 114/219; 405/1
(58) Field of Search ..... 405/1–7; 114/344, 114/219, 361, 44–48, 230.1

(56) References Cited

U.S. PATENT DOCUMENTS

| | | | | |
|---|---|---|---|---|
| 2,658,354 | | 11/1953 | Lee | 61/67 |
| 5,449,247 | | 9/1995 | Smith | 405/3 |
| 5,460,112 | | 10/1995 | Travioli | 114/230 |
| 5,961,139 | * | 10/1999 | Nichols, II | 280/414.1 |
| 6,092,961 | * | 7/2000 | Kilgore | 405/7 |

* cited by examiner

*Primary Examiner*—Ed Swinehart
(74) *Attorney, Agent, or Firm*—Donald J. Ersler

(57) ABSTRACT

A boat landing apparatus includes a pair of roller assemblies, a pair of cross members, four cross member brackets, and at least two retention stakes. Each roller assembly includes a plurality of rollers pivotally retained in a roller frame. Each cross member bracket is mounted to substantially each end of each roller assembly. A wedge spacer may be mounted between a bottom of the roller frame and the cross member bracket. The wedge spacer enables the roller assembly to have an inward tilt. An opening is formed through substantially a center of the bracket and the roller frame. Each cross member bracket is sized to slidably receive the cross section of the cross member. Each cross member has a plurality of openings formed along a length thereof. The width of the boat landing apparatus may be adjusted by aligning the opening in the roller frame with one of the openings in the cross member. A single stake is then inserted through the openings in the roller assembly and cross bracket into the mounting surface. A height spacer may be used to adjust the rear height of the boat landing apparatus.

18 Claims, 5 Drawing Sheets

BOAT LANDING APPARATUS

BACKGROUND OF THE INVENTION

1. Field of the Invention

The present invention relates generally to landing a boat on shore and more specifically to a boat landing apparatus which may be used to easily land and retain a boat without removing thereof from the water.

2. Discussion of the Prior Art

There are numerous boating landing devices such as U.S. Pat. No. 2,658,354 to Lee, U.S. Pat. No. 5,449,247 to Smith, and U.S. Pat. No. 5,460,112 to Travioli. All three of the these patents have the same drawback. Only a small length of the boat is guided when the boat is in contact with the boat landing device. A boat landing device which only contacts a small length of the boat lacks stability.

Accordingly, there is a clearly felt need in the art for a boat landing apparatus which provides greater stability when landing a boat than that of the prior art.

SUMMARY OF THE INVENTION

The present invention provides a boat landing apparatus which is easier to use than that of the prior art. The boat landing apparatus includes a pair of roller assemblies, a pair of cross members, four cross member brackets, and at least two retention stakes. Each roller assembly includes a plurality of rollers pivotally retained in a roller frame. Each cross member bracket is mounted to substantially each end of each roller assembly. A wedge spacer may be mounted to a bottom of the roller frame before attachment of the cross member bracket. The wedge spacer enables the roller assembly to have an inward tilt. An opening is formed through substantially a center of the bracket and the roller frame. Each cross member bracket is sized to slidably receive the perimeter of the cross member. Each cross member has a plurality of openings formed along a length thereof. The width of the boat landing apparatus may be adjusted by aligning the opening in the roller frame with one of the openings in the cross member. A single stake is then inserted through the openings in the roller assembly and cross member into the mounting surface.

A height spacer may be used to tilt the boat landing device. The height spacer allows the boat landing apparatus to be tilted for raising or lowering either end of the boat. The rear of the boat may be tilted downward to drain water therefrom, if necessary. The height spacer preferably includes a post retainer, a tubular post, and a flange retainer. A single post retainer is attached to a bottom of each end of each roller assembly. The tubular post is retained by the post retainer. The flange retainer is clamped to the tubular post to prevent thereof from sinking into the lake bottom.

Accordingly, it is an object of the present invention to provide a boat landing apparatus which provides greater stability when landing a boat than that of the prior art.

It is a further object of the present invention to provide a boat landing apparatus which may be tilted to adjust to a sloped lake bottom.

Finally, it is another object of the present invention to provide a boat landing apparatus which has an adjustable width to accommodate different size boats.

These and additional objects, advantages, features and benefits of the present invention will become apparent from the following specification.

DETAILED DESCRIPTION OF THE PREFERRED EMBODIMENTS

Figure 1:
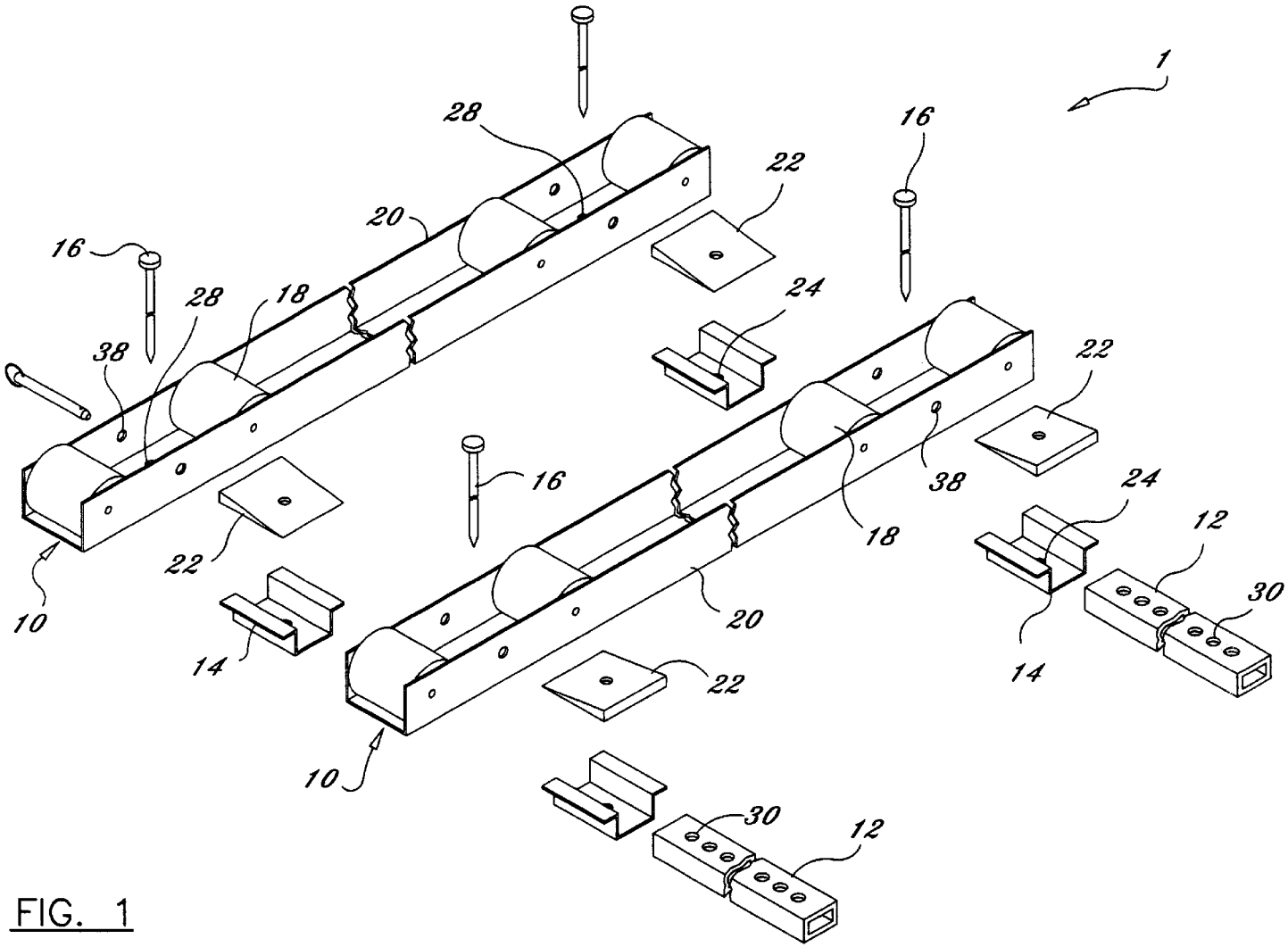
FIG. 1 is an exploded perspective view of a boat landing apparatus in accordance with the present invention.
Figure 2:
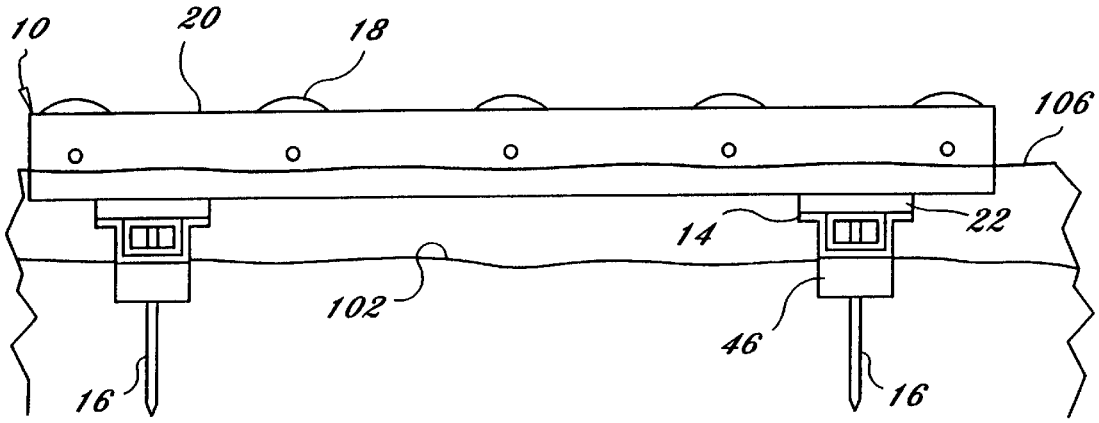
FIG. 2 is a side view of a boat landing apparatus in accordance with the present invention.
Figure 3:
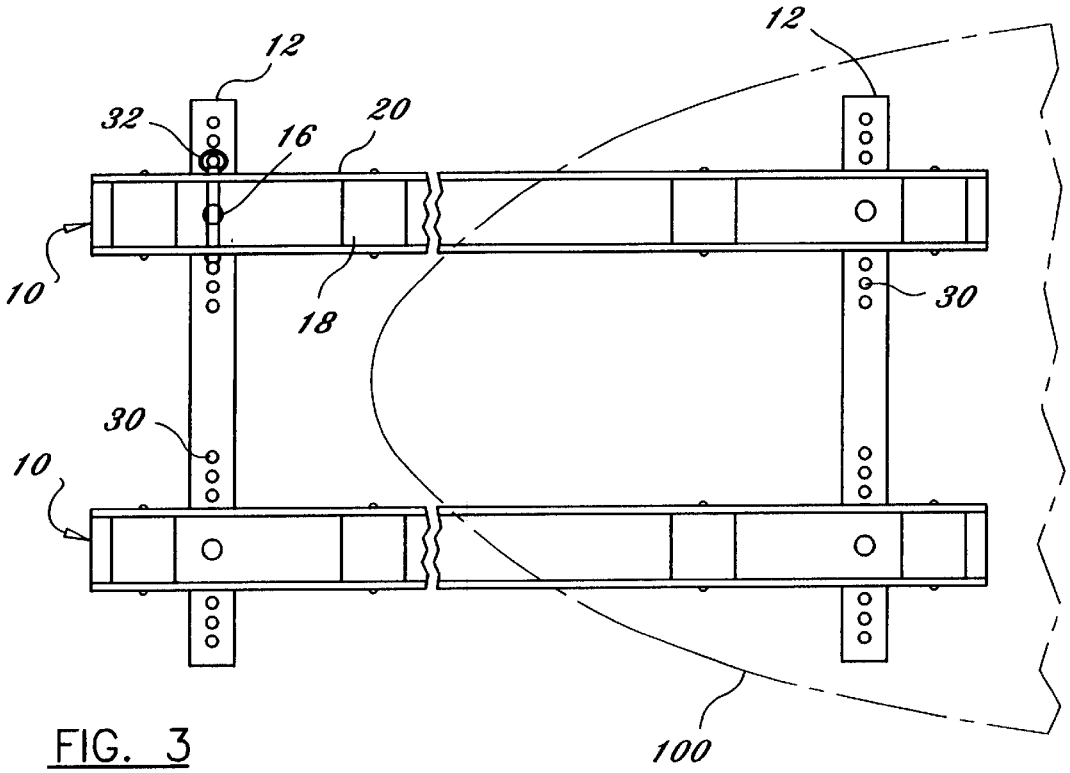
FIG. 3 is a top view of a boat landing apparatus in accordance with the present invention.
Figure 4:
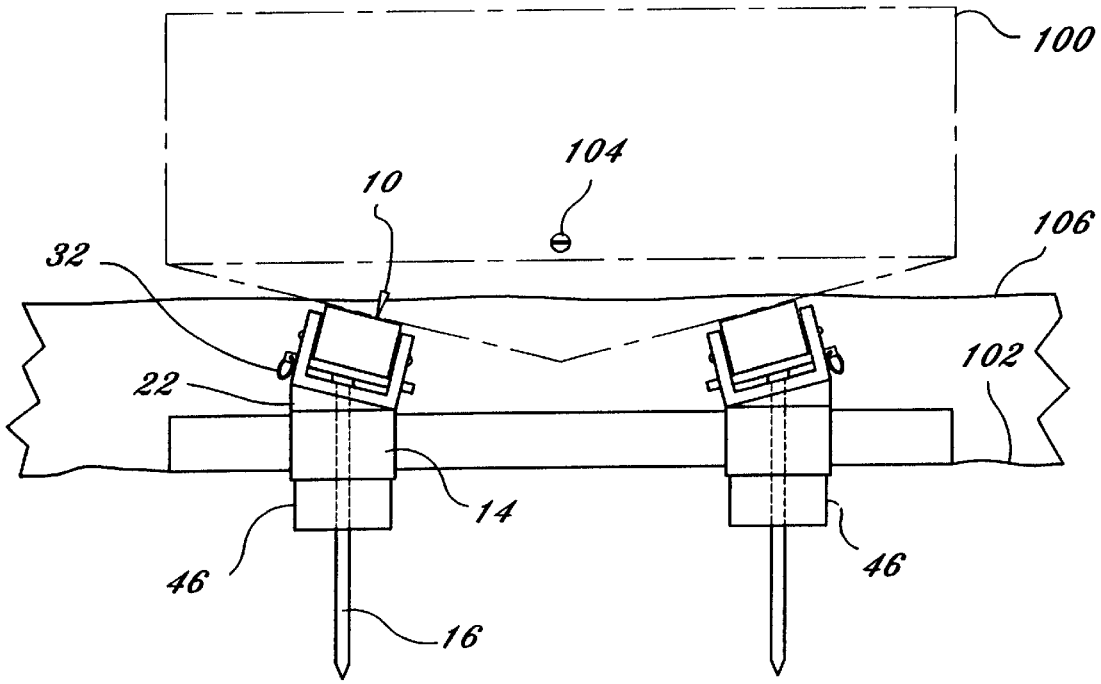
FIG. 4 is a rear view of a boat landing apparatus in accordance with the present invention.

With reference now to the drawings, and particularly to FIG. 1, there is shown an exploded perspective view of a boat landing apparatus 1. With reference to FIGS. 2 and 3, the boat landing apparatus 1 includes a pair of roller assemblies 10, a pair of cross members 12, four cross member brackets 14, and at least two retention stakes 16. Each roller assembly 10 includes a plurality of rollers 18 pivotally retained in a roller frame 20. The roller assembly 10 is preferably purchased from Marine & Trailer Products. One particular design of roller assembly 10 is shown, but other designs of roller assemblies may also be used. A single cross member bracket 14 is mounted to substantially each end of each roller frame 20. The cross member bracket 14 is preferably fabricated from an aluminum sheet stock. Other suitable materials may also be used. A wedge spacer 22 may be mounted to a bottom of the roller frame 20 before attachment of the cross member bracket 14. The wedge spacer 22 enables the roller assembly 10 to have an inward tilt to guide a front of a boat 100 into the boat landing apparatus 1 as shown in FIG. 3. If no tilt is required, then the wedge spacer 22 is not included with the boat landing apparatus 1. The wedge spacer 22 may be fabricated from any material which does not corrode in water.

The cross member bracket 14 and/or the wedge spacer 22 may be attached to a bottom of the roller frame 20 with welding, fasteners, adhesive, or any other suitable assembly process. The cross member bracket 14 may be attached to a bottom of the wedge spacer 22 with welding, fasteners, adhesive, or any other suitable assembly process. An opening 24 is formed through substantially a center of the cross member bracket 14, an opening 26 is formed through the wedge spacer 22, and an opening 28 is formed through substantially each end of the roller frame 20. Each cross member bracket 14 is sized to slidably receive the perimeter of the cross member 12.

Each cross member 12 has a plurality of openings 30 formed along a length thereof. The width of the boat landing apparatus 1 may be adjusted by aligning the opening 28 in the roller frame 20 with one of the openings 30 in the cross member 12. The cross member 12 is preferably fabricated from an rectangular cross section of aluminum tube. Other suitable materials may also be used. A single stake 16 is then inserted through the openings into the mounting surface 102. Each stake 16 preferably has a horizontally serrated surface to enhance retention by the mounting surface 102 such as sand on a lake floor. The stake is preferably fabricated from an aluminum rod. Other suitable materials may also be used. A single post retainer 46 is preferably attached to each end of each roller assembly 10 at a bottom thereof with any suitable assembly process such as welding.

Figure 5:
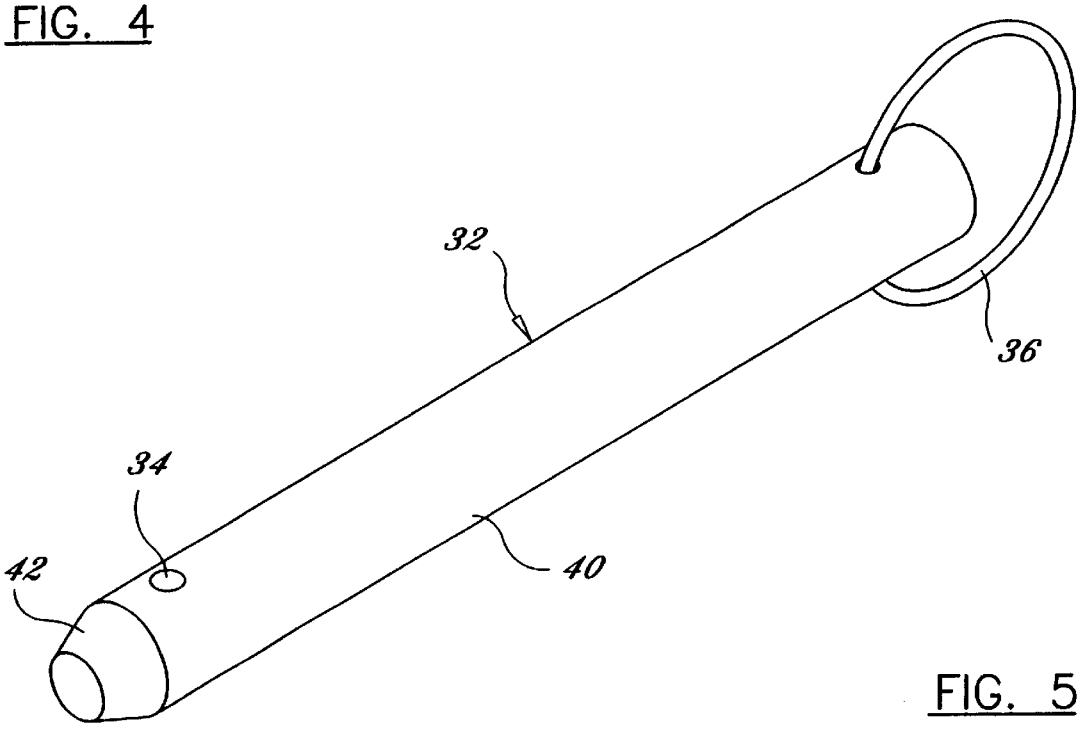
FIG. 5 is a perspective view of a stake retention pin of a boat landing apparatus in accordance with the present invention.

With reference to FIG. 5, preferably a stake pin 32 is utilized to prevent the stake pin 16 from working its way out of the mounting surface 102. A pair of openings 38 are formed through the sides of the roller frame 20 and the stake pin 32 is inserted therethrough. The stake pin 32 preferably includes a pin body 40, a tapered front end 42, at least one spring loaded ball 34 and a withdrawal ring 36 disposed on a rear end. Other methods and devices may also be used to prevent the stake 16 from withdrawing from the mounting surface 102. The stake pin 32 may be purchased as a standard product from a tool component manufacturer.

Figure 6:
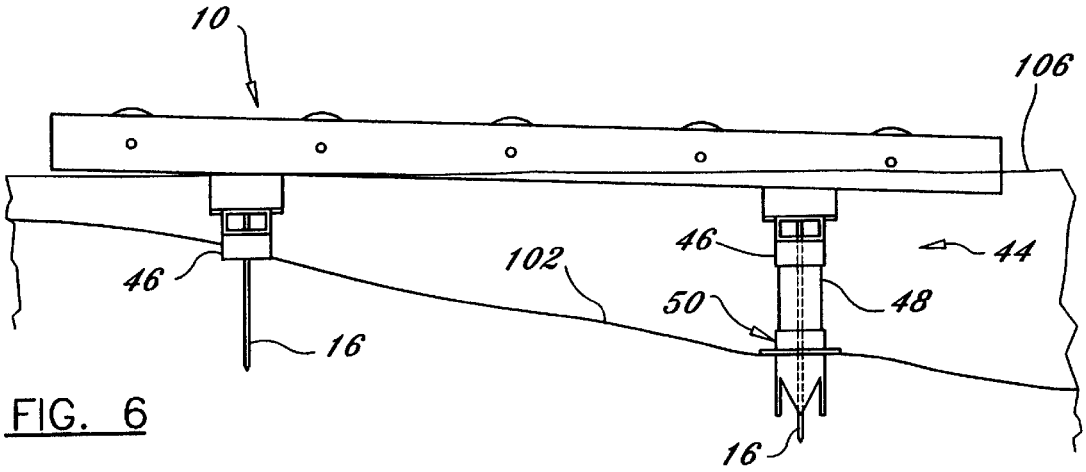
FIG. 6 is a side view of a boat landing apparatus with a pair of height spacers in accordance with the present invention.
Figure 9:
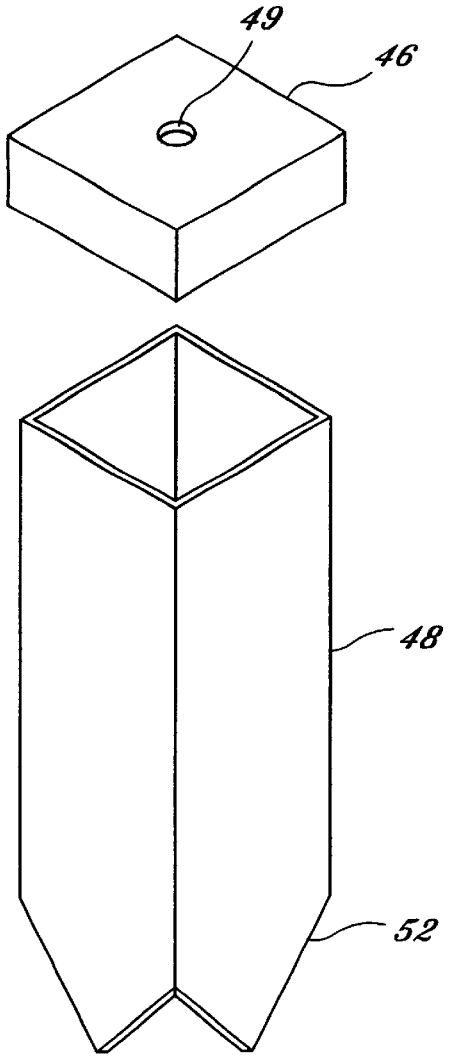
FIG. 9 is a cross sectional view of a post retainer of a boat landing apparatus in accordance with the present invention.
Figure 9:
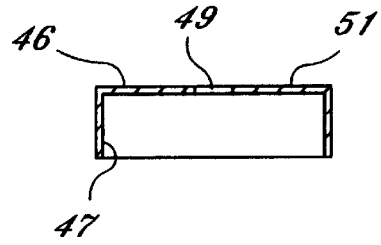
Figure 8:
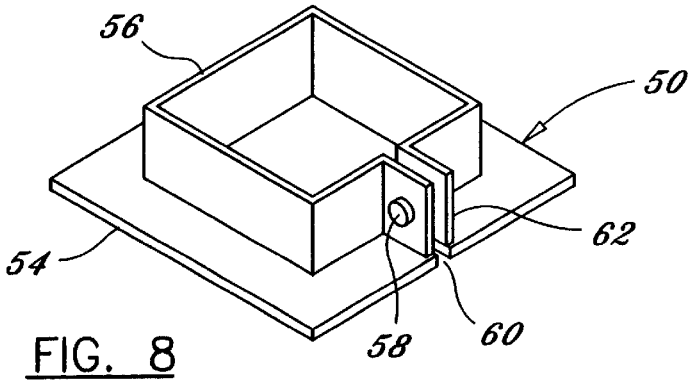
FIG. 8 is an exploded perspective view of a height spacer of a boat landing apparatus in accordance with the present invention.

With reference to FIGS. 6, 8 and 9, a height spacer 44 may be used to adjust the height of one end of the boat landing device 1. The height spacer 44 preferably includes a tubular post 48 and a flange retainer 50. The post retainer 46 is preferably a tubular device with a top portion 51. The post retainer has an inner perimeter 47 which is sized slidably receive the tubular post 48. A stake clearance hole 49 is formed through the top portion 51 of the post retainer 46. A point 52 is preferably formed on a bottom of each side of the tubular post 48. The point 52 facilitates insertion of the tubular post 48 into a lake bottom. A square shaped tubular post 48 is shown, but other shapes may also be used.

A flange retainer 50 includes a flange plate 54, a clamp 56, and a fastener 58. The clamp 56 is preferably attached to a top of the flange plate 54 with any suitable assembly process such as welding. A slit 60 is formed in the flange plate 54 adjacent a tightening flange 62. The slit 60 allows the clamp to be tightened around the tubular post 48. The attachment of the flange retainer 50 to the tubular post 48 prevents the rear of the boat landing apparatus 1 from sinking into a lake bottom. The fastener 58 is used to tighten the clamp 50 against the tubular post 48. The post retainer 46, tubular post 48, and flange retainer 50 are preferably fabricated from any material which does not corrode in water. Other designs of height spacers may also be used.

Figure 7:
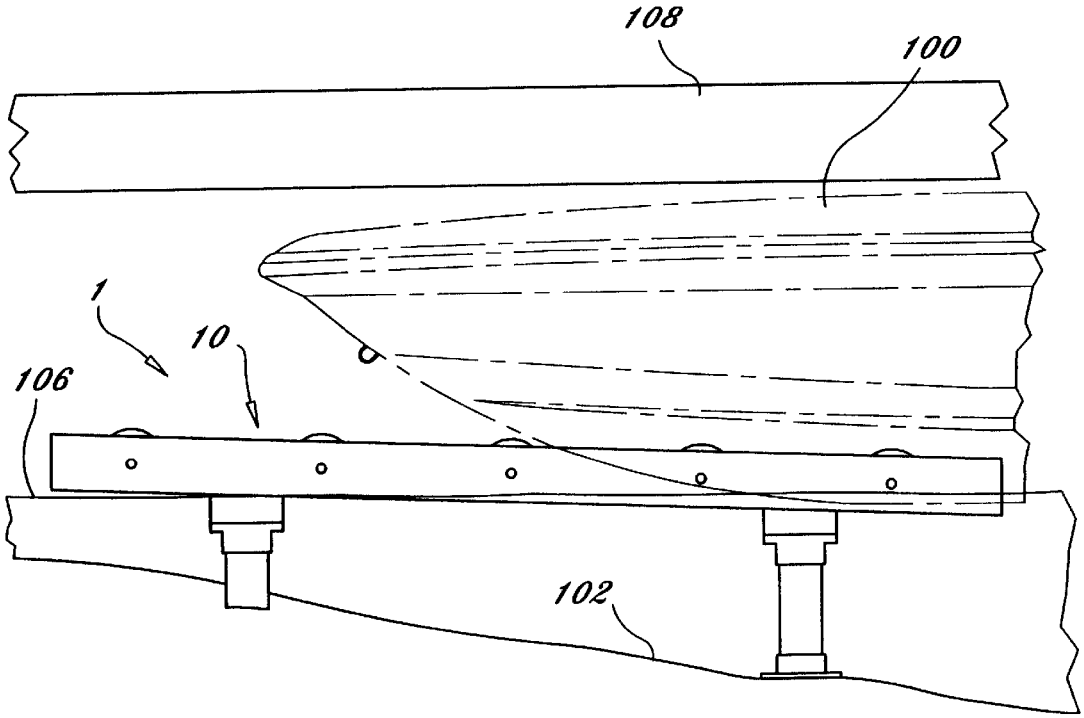
FIG. 7 is a side view of a boat landing apparatus with a boat partially landed thereupon adjacent a pier in accordance with the present invention.

FIG. 7 shows a boat 100 pulled half way on to a boat landing apparatus 1 adjacent a pier 108.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A boat landing apparatus comprising:

a pair of roller assemblies, each said roller assembly including a plurality of rollers pivotally attached to a roller frame, one opening being formed through said roller frame at substantially one end thereof;

at least two cross members, each said cross member having a plurality of cross member openings formed along a length thereof;

at least two stakes, a single said stake being inserted through a single said opening and a single said cross member opening to secure said roller frame to said cross member.

2. The boat landing apparatus of claim 1, further comprising:

a cross member bracket being attached to substantially each end of each said roller frame, said cross member bracket being sized to slidably receive said cross member.

3. The boat landing apparatus of claim 2, further comprising:

a wedge spacer being attached between a bottom of said roller frame and a top of said cross member bracket, said wedge spacer causing said roller assembly to tilt inward to facilitate easy loading of a boat, said cross member bracket being sized to slidably receive said cross member.

4. The boat landing apparatus of claim 1, further comprising:

a stake pin having a tapered front end and a ring formed on the other end thereof, an opening being formed through sides of said roller frame adjacent said opening in a bottom of said roller frame, said stake pin preventing said stake from pushing upward from said bottom of said roller frame.

5. The boat landing apparatus of claim 1, further comprising:

a single post retainer being attached to each end of each said roller assembly at a bottom thereof.

6. The boat landing apparatus of claim 1, further comprising:

a height spacer being attached to a bottom of each roller assembly at substantially a rear thereof, said height spacer allowing the vertical adjustment of the boat landing assembly relative to a lake bottom.

7. The boat landing apparatus of claim 5, further comprising:

a height spacer including a tubular post and a flange retainer, said post retainer being sized to slidably receive said tubular post, a flange retainer being clamped along the length of said tubular post.

8. A boat landing apparatus comprising:

a pair of roller assemblies, each said roller assembly including a plurality of rollers pivotally attached to a roller frame, one opening being formed at substantially one end thereof;

at least two cross members, each said cross member having a plurality of cross member openings formed along a length thereof;

a cross member bracket being attached to substantially each end of each said roller frame, said cross member bracket being sized to slidably receive said cross member; and at least two stakes, a single said stake being inserted through said opening in said roller frame, said cross member bracket, and said cross member opening to secure said roller frame to said cross member.

9. The boat landing apparatus of claim 8, further comprising:

a wedge spacer being attached between a bottom of said roller frame and a top of said cross member bracket, said wedge spacer causing said roller assembly to tilt inward to facilitate easy loading of a boat, said cross member bracket being sized to slidably receive said cross member.

10. The boat landing apparatus of claim 8, further comprising:

a stake pin having a tapered front end and a ring formed on the other end thereof, an opening being formed through sides of said roller frame adjacent said opening in a bottom of said roller frame, said stake pin preventing said stake from pushing upward from said bottom of said roller frame.

11. The boat landing apparatus of claim 8, further comprising:

a single post retainer being attached to each end of each said roller assembly at a bottom thereof.

12. The boat landing apparatus of claim 8, further comprising:

a height spacer being attached to a bottom of each roller assembly at substantially a rear thereof, said height spacer allowing the vertical adjustment of the boat landing assembly relative to a lake bottom.

13. The boat landing apparatus of claim 11, further comprising:

a height spacer including a tubular post and a flange retainer, said post retainer being sized to slidably receive said tubular post, a flange retainer being clamped along the length of said tubular post.

14. A boat landing apparatus comprising:

a pair of roller assemblies, each said roller assembly including a plurality of rollers pivotally attached to a roller frame, one opening being formed at substantially one end thereof;

at least two cross members, each said cross member having a plurality of cross member openings formed along a length thereof;

a wedge spacer being attached to substantially each end of said roller frame at a bottom thereof;

a cross member bracket being attached to a bottom of each wedge spacer, said cross member bracket being sized to slidably receive said cross member; and at least four stakes, a single said stake being inserted through said opening in said roller frame, said spacer said cross member bracket, and said cross member opening to secure said roller frame to said cross member.

15. The boat landing apparatus of claim 14, further comprising:

a stake pin having a tapered front end and a ring formed on the other end thereof, an opening being formed through sides of said roller frame adjacent said opening in a bottom of said roller frame, said stake pin preventing said stake from pushing upward from said bottom of said roller frame.

16. The boat landing apparatus of claim 14, further comprising:

a single post retainer being attached to each end of each said roller assembly at a bottom thereof.

17. The boat landing apparatus of claim 14, further comprising:

a height spacer being attached to a bottom of each roller assembly at substantially a rear thereof, said height spacer allowing the vertical adjustment of the boat landing assembly relative to a lake bottom.

18. The boat landing apparatus of claim 16, further comprising:

a height spacer including a tubular post and a flange retainer, said post retainer being sized to slidably receive said tubular post, a flange retainer being clamped along the length of said tubular post.

* * * * *